US009443642B2

(12) United States Patent
Matsuno

(10) Patent No.: US 9,443,642 B2
(45) Date of Patent: Sep. 13, 2016

(54) ELECTRICAL WIRE

(71) Applicant: Yazaki Corporation, Tokyo (JP)

(72) Inventor: Takayuki Matsuno, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/679,182

(22) Filed: Apr. 6, 2015

(65) Prior Publication Data

US 2015/0213922 A1 Jul. 30, 2015

Related U.S. Application Data

(62) Division of application No. 13/822,869, filed as application No. PCT/JP2011/073026 on Sep. 29, 2011, now abandoned.

(30) Foreign Application Priority Data

Oct. 1, 2010 (JP) ..... 2010-224335

(51) Int. Cl.

| | |
|---|---|
| ***H01B 5/08*** | (2006.01) |
| ***H01B 7/295*** | (2006.01) |
| ***H01B 5/00*** | (2006.01) |
| ***H01B 7/00*** | (2006.01) |
| ***H01B 7/17*** | (2006.01) |
| ***H01B 1/02*** | (2006.01) |
| *H01B 13/02* | (2006.01) |

(52) U.S. Cl.

CPC ..... *H01B 7/0009* (2013.01); *H01B 1/023* (2013.01); *H01B 7/17* (2013.01); *H01B 13/02* (2013.01)

(58) Field of Classification Search

CPC ..... H01B 7/0009
USPC ..... 174/126.1, 128.1, 128.2, 110 R
See application file for complete search history.

(56) References Cited

U.S. PATENT DOCUMENTS

| | | | | |
|---|---|---|---|---|
| 4,078,299 | A | 3/1978 | Furuto et al. | |
| 5,149,917 | A * | 9/1992 | Sawada | B60R 16/0215 174/110 R |
| 5,260,516 | A * | 11/1993 | Blackmore | H01B 5/08 174/113 A |
| 6,331,676 | B1 * | 12/2001 | Gutierrez | H01B 7/0009 174/128.1 |

(Continued)

FOREIGN PATENT DOCUMENTS

| | | | |
|---|---|---|---|
| JP | 62-262315 | A | 11/1987 |
| JP | 2000-251530 | A | 9/2000 |

(Continued)

OTHER PUBLICATIONS

Notification of Reasons for Rejection mailed Mar. 27, 2012, issued for the corresponding Japanese patent application No. 2010-224335 and English translation thereof.

International Search Report dated Jan. 17, 2012, issued for PCT/JP2011/073026.

*Primary Examiner* — Sherman Ng
(74) *Attorney, Agent, or Firm* — Locke Lord LLP

(57) ABSTRACT

The present invention provides an electrical wire which includes a conductor portion comprising a plurality of element wires being twisted together, and an insulating covering portion disposed over the conductor portion. Each of element wires is formed of aluminum or aluminum alloy material, and has a circular cross-section. The stranding pitch of the element wires is at least three times greater than a pitch diameter of the conductor portion but no more than thirty times greater than the pitch diameter of the conductor portion.

7 Claims, 4 Drawing Sheets

(56) References Cited

U.S. PATENT DOCUMENTS

| | | | | |
|---|---|---|---|---|
| 6,333,465 | B1 | 12/2001 | Prudhon | |
| 6,576,844 | B1 | 6/2003 | Kamata | |
| 2003/0037957 | A1 | 2/2003 | Ueno et al. | |
| 2008/0196923 | A1* | 8/2008 | Susai | H01B 1/023 174/110 R |
| 2008/0314613 | A1 | 12/2008 | Huang et al. | |
| 2009/0166057 | A1 | 7/2009 | Kondo et al. | |
| 2009/0188231 | A1 | 7/2009 | Song | |

FOREIGN PATENT DOCUMENTS

| | | | |
|---|---|---|---|
| JP | 2004-087436 | A | 3/2004 |
| JP | 2005-190746 | A | 7/2005 |
| JP | 2006-079885 | A | 3/2006 |
| JP | 2006-156346 | A | 6/2006 |
| JP | 2006-253093 | A | 9/2006 |
| JP | 2008-218273 | A | 9/2008 |
| JP | 2009-170315 | A | 7/2009 |
| WO | WO-2009/054457 | A1 | 4/2009 |

* cited by examiner

ELECTRICAL WIRE

This application is a divisional application of U.S. application Ser. No. 13/822,869 filed Mar. 13, 2013 which claims the right of priority under 35 U.S.C. §119 based on Japanese Patent Application No. 2010-224335 filed Oct. 1, 2010.

TECHNICAL FIELD

The present invention relates to an electrical wire comprising a conductor portion including a plurality of element wires, each of which is composed of aluminum or aluminum alloy material.

BACKGROUND ART

Conventionally, there has been proposed or suggested that copper or copper alloy element wire is substituted by aluminum or aluminum alloy element wire in the conductor portion of an electrical wire so as to decrease the weight of wiring harness to be disposed in a vehicle. For example, see Japanese Publication of Patent Application No. 2009-170315A. The electrical wire to which a terminal fitting is coupled or attached can be mounted to the wiring harness.

However, aluminum or aluminum alloy material generally has less mechanical strength in comparison with copper or copper alloy material which has been used as element wire material for a conductor of an electrical wire. Accordingly, in a case where an electrical wire having a conductor portion composed of aluminum or aluminum alloy element wire(s) is employed in a wiring harness for a vehicle, in particular, the door portion of vehicle, the element wire is prone to break or fracture.

SUMMARY OF THE INVENTION

It is an objective of the present invention to provide an electrical wire comprising a conductor portion having a plurality of element wires each of which is composed of aluminum or aluminum alloy material, and is prevented from break or fracture even if the electrical wire is used for a wiring harness to be disposed inside a vehicle.

In one aspect the invention relates to such an electrical wire, comprising, a conductor portion comprising a plurality of element wires being twisted together, and an insulating covering portion disposed over the conductor portion, wherein each of the element wires is formed of aluminum or aluminum alloy material, and has a circular cross-section, and wherein a stranding pitch of the element wires is at least three times greater than a pitch diameter of the conductor portion but no more than thirty times greater than the pitch diameter of the conductor portion.

Preferably, the stranding pitch of the element wires may be at least three times greater than the pitch diameter of the conductor portion but no more than twenty times greater than the pitch diameter of the conductor portion.

More preferably, the stranding pitch of the element wires may be at least ten times greater than the pitch diameter of the conductor portion but no more than twenty times greater than the pitch diameter of the conductor portion.

In another aspect the invention relates to such an electrical wire, comprising, a conductor portion comprising a plurality of element wires being twisted together, and an insulating covering portion disposed over the conductor portion, wherein each of the element wires is formed of aluminum or aluminum alloy material, and has a circular cross-section, and wherein a stranding pitch of the element wires is at least three times greater than an outer diameter the conductor portion but no more than thirty times greater than the outer diameter of the conductor portion.

Preferably, the stranding pitch of the element wires may be at least three times greater than the outer diameter the conductor portion but no more than twenty times greater than the outer diameter of the conductor portion.

More preferably, the stranding pitch of the element wires may be at least five times greater than the outer diameter the conductor portion but no more than fifteen times greater than the outer diameter of the conductor portion.

Other objects, features, and advantages of the present invention will become apparent after review of the specification, claims, and drawings.

DETAILED DESCRIPTION OF THE INVENTION

Figure 1:
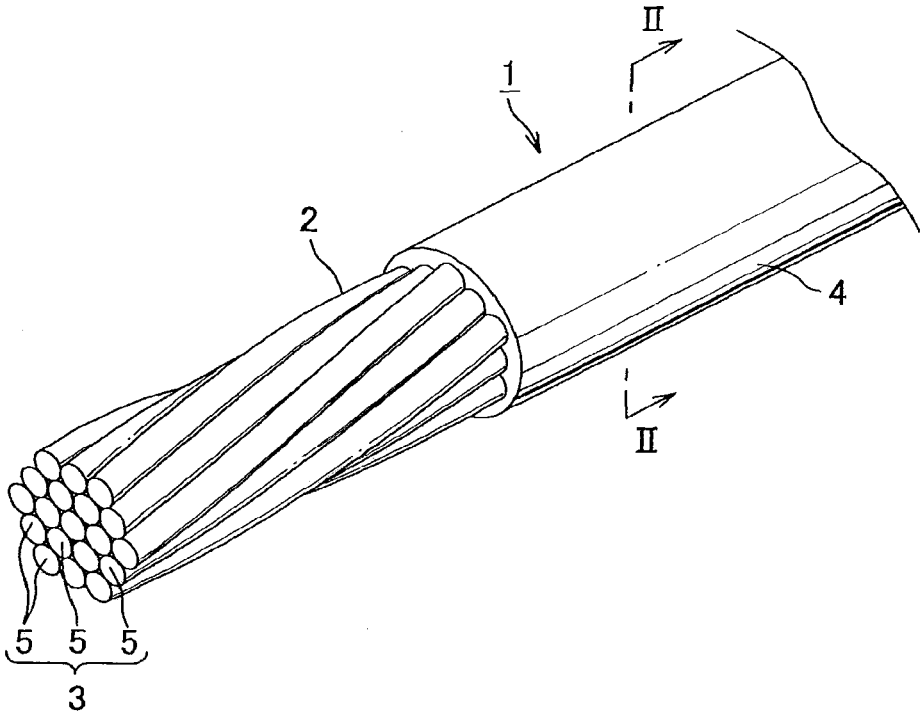
FIG. 1 shows a perspective view of a first embodiment of an electrical wire in accordance with the invention.
Figure 2:
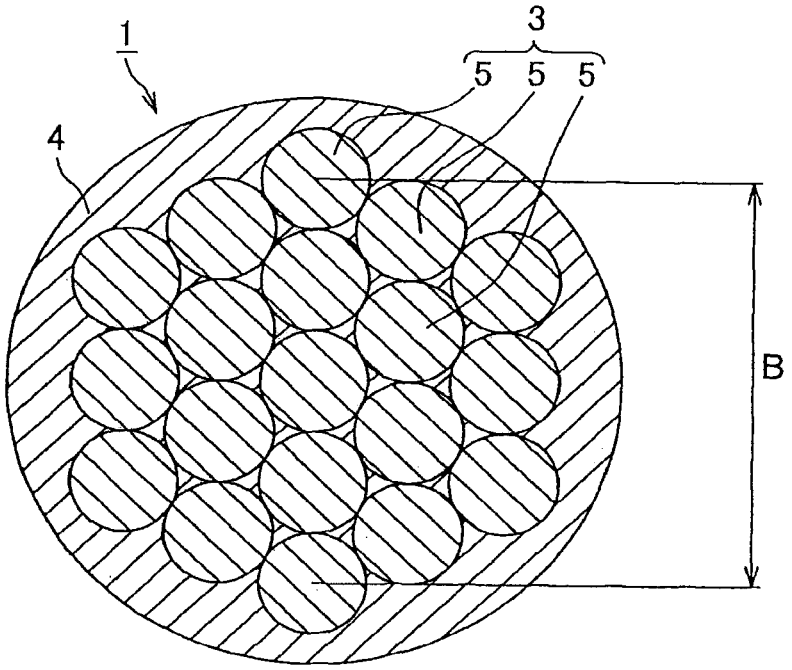
FIG. 2 shows a cross-sectional view of the electrical wire of FIG. 1 along the line II.

A first embodiment of an electrical wire in accordance with the present invention will be described with reference to FIGS. 1 to 3 attached thereto. As shown in FIGS. 1 and 2, the first embodiment of the electrical wire 1 in accordance with the invention has a conductor portion 3, and an insulating covering portion 4 disposed over the conductor portion 3.

The conductor portion 3 is composed of a plurality of element wires 5. The conductor portion 3 is shown to include 19 element wires therein. Each of the element wires 5 is substantially formed of aluminum or aluminum alloy material as conductive metal. In this regard, the element wire 5 may include inevitable or unavoidable impurities in addition to aluminum or aluminum alloy material therein.

The element wire 5 can be obtained by a drawing process in which a rod-like aluminum or aluminum alloy metallic material can be passed through the hole of dies (not shown). In other words, the element wire 5 is never subjected to compression, and is thus formed having a circular cross-section.

Moreover, the conductor portion 3 is formed by tying the plurality of element wires 5 together, and twisting the plurality of element wires 5 with respect to the shaft center of the conductor portion 3. In other words, the conductor portion 3 is formed by twisting the plurality of element wires 5 together. Accordingly, the element wires 5 spirally wrap around each other so as to form the conductor portion 3.

Figure 3:
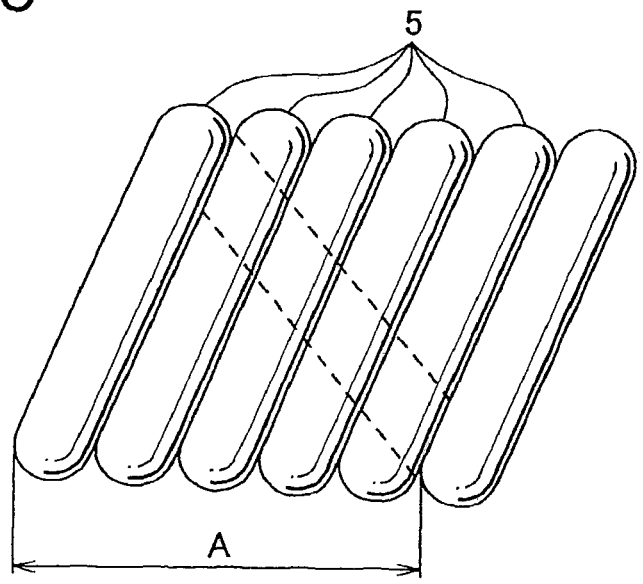
FIG. 3 shows a stranding pitch of the element wires of a conductor.

With reference to FIGS. 2 and 3, a stranding pitch A of the element wires 5 (see FIG. 3) is at least three times greater than pitch diameter B (also called as "diameter of layer core B") (see FIG. 2) of the conductor portion 3 but no more than thirty times greater than the pitch diameter B of the conductor portion 3. In other words, the element wires 5 of the conductor portion 3 are spirally twisted such that the stranding pitch A is at least three times greater than the pitch diameter B of the conductor portion 3 but no more than thirty times greater than the pitch diameter B of the conductor portion 3. The term "stranding pitch A" as used herein is defined as a length along the conductor portion 3 needed to make one complete rotation (360 degree) of the helically applied or helically laid element wires. The pitch diameter B as used herein can be determined by subtracting one outer diameter of the element wire 5 from maximum outer diameter of the conductor portion 3. In other words, the pitch diameter B can be defined by the outer diameter of circle passing the center shaft of the element wire 5 which is located at the outmost circumference. Moreover, due to the outer diameter of the element wire 5 itself, it is physically impossible that the stranding pitch A is less than three times greater than the pitch diameter B of the conductor portion 3. In other words, the conductor portion 3 in which the element wires 5 are twisted together is formed such that the stranding pitch A is at least three times greater than the pitch diameter B of the conductor portion 3.

In certain such embodiments, stranding pitch A of the element wires 5 of the conductor portion 3 is preferably at least three times greater than the pitch diameter B of the conductor portion 3 but no more than twenty times greater than the pitch diameter B of the conductor portion 3. More preferably, the stranding pitch A of the element wires 5 of the conductor portion 3 is at least ten times greater than the pitch diameter B of the conductor portion 3 but no more than twenty times greater than the pitch diameter B of the conductor portion 3.

The covering portion 4 is formed of insulating synthetic resin, and is disposed over the conductor portion 3. The covering portion 4 has approximately annular cross-section. Both the conductor portion 3 and the covering portion 4 disposed over the conductor portion 3 constitute the electrical wire 1 being circular in cross-section. The covering portion 4 is removed from the electrical wire 1 at the area of the end portion 2 of the electrical wire 1, and the conductor portion 3 is thus exposed to outside at the end portion 2 of the electrical wire 1.

The exposed conductor portion 3 is coupled to, or attached to a terminal fitting (not shown) at the end portion 2 of the electrical wire 1. The terminal fitting can be coupled to a connector housing, and the connector for the end portion 2 is attached thereby forming a wiring harness to be mounted inside a vehicle.

In accordance with such embodiment, the stranding pitch A of the element wires 5 is at least three times greater than the pitch diameter B of the conductor portion 3 but no more than thirty times greater than the pitch diameter B of the conductor portion 3. The above stranding pitch A is far less than stranding pitch of the element wires of a conventional electrical wire. As such, the element wires 5 of the conductor portion 3 are much more tightly twisted together in comparison with the element wires of the conductor portion of the conventional electrical wire. As a result, the surplus length of the element wire(s) 5 constituting the conductor portion 3 inside the electrical wire 1 is much greater than that of the element wire(s) of the conductor portion of the conventional electrical wire.

For the reason as set forth above, even if the electrical wire 1 is repeatedly bent, distortion of the element wire 5 due to the above repetitive bend can be reliably decreased. Therefore, the element wires 5 formed of aluminum or aluminum alloy material can be effectively prevented from break or fracture even if they are employed for a wiring harness to be disposed inside a vehicle.

Moreover, in a case where the stranding pitch A of the element wires 5 is at least three times greater than the pitch diameter B of the conductor portion 3 but no more than twenty times greater than the pitch diameter B of the conductor portion 3, distortion of the element wire 5 due to the above repetitive bend can be reliably decreased. Therefore, the element wires 5 formed of aluminum or aluminum alloy material can be effectively prevented from break or fracture even if they are employed for a wiring harness to be disposed inside a vehicle.

In addition, in a case where the stranding pitch A of the element wires 5 is at least ten times greater than the pitch diameter B of the conductor portion 3 but no more than twenty times greater than the pitch diameter B of the conductor portion 3, distortion of the element wire 5 due to the above repetitive bend can be reliably decreased. Therefore, the element wires 5 formed of aluminum or aluminum alloy material can be effectively prevented from break or fracture even if they are used for a wiring harness to be disposed inside a vehicle.

Figure 4:
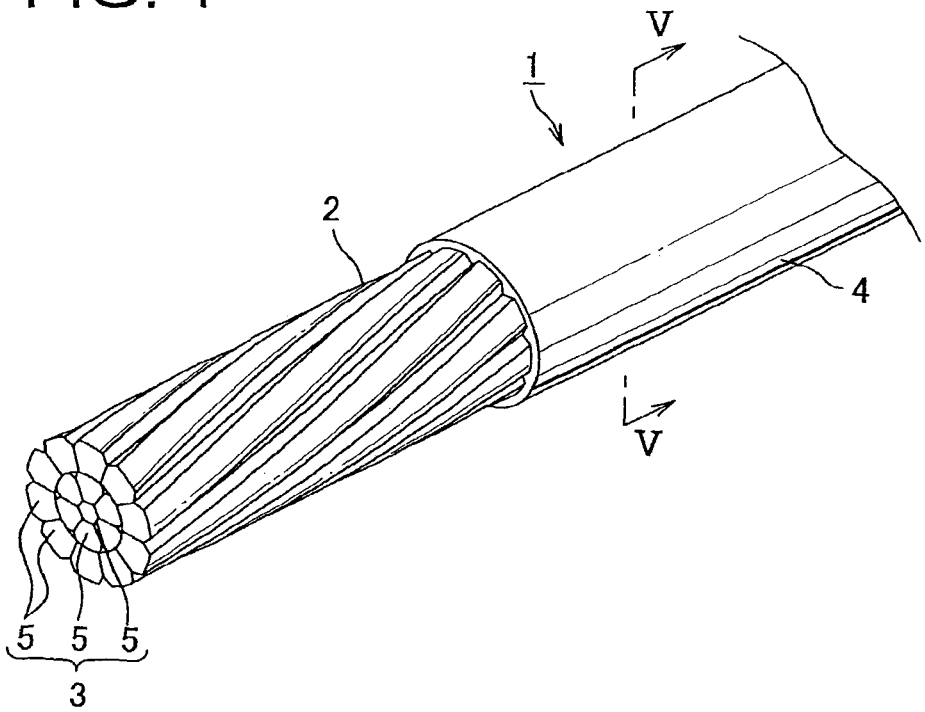
FIG. 4 shows a perspective view of a second embodiment of an electrical wire in accordance with the invention.
Figure 5:
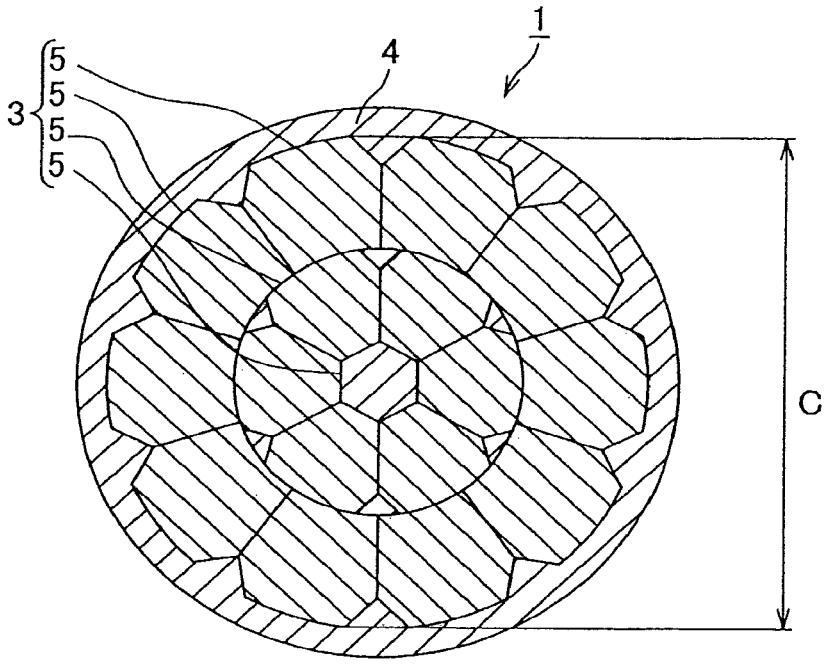
FIG. 5 shows a cross-sectional view of the electrical wire of FIG. 4 along the line V.

With reference to FIGS. 4 and 5, a second embodiment of an electrical wire 1 in accordance with the present invention will be described in detail. The same parts, elements and/or pieces as the first embodiment of the electrical wire will be represented by the same symbol, and the detailed description for the corresponding parts, elements and pieces will be omitted.

In the second embodiment of the electrical wire 1 in accordance with the present invention, a conductor portion 3 in which a plurality of element wires 5 is twisted together is subjected to compression so as to decrease its cross-sectional area. As a result, the element wires 5 each having an approximately hexagonal cross-section are formed. In other words, each of the element wires 5 constituting the conductor portion 3 is formed as a compressed conductor. Moreover, the compressed conductor as described herein is obtained by subjecting an element wire or cable (i.e., a conductor) to compression to decrease its cross-sectional area. The above compression can be performed by use of dies (not shown) and etc.

In the second embodiment of the electrical wire 1, the stranding pitch A of the element wires 5 is at least three times greater than an outer diameter C (see FIG. 5) of the conductor portion 3 but no more than thirty times greater than the outer diameter C of the conductor portion 3. In other words, the element wires 5 are twisted such that the stranding pitch A of the element wires 5 is at least three times greater than the outer diameter C of the conductor portion but no more than thirty times greater that the outer diameter C of the conductor portion 3. Moreover, due to the outer diameter of the element wire 5 itself, it is physically impossible that the stranding pitch A is less than three times greater than the outer diameter C of the conductor portion 3. In other words, the conductor portion 3 in which the element wires 5 are twisted together is formed such that the stranding pitch A is at least three times greater than the outer diameter C of the conductor portion 3.

In certain such embodiments, the stranding pitch A of the element wires 5 of the conductor portion 3 is preferably at least three times greater than the outer diameter C of the conductor portion 3 but no more than twenty times greater than the outer diameter C of the conductor portion 3. More preferably, the stranding pitch A of the element wires 5 of the conductor portion 3 is at least five times greater than the outer diameter C of the conductor portion 3 but no more than fifteen times greater than the outer diameter C of the conductor portion 3.

In accordance with the second embodiment of the electrical wire 1, the stranding pitch A of the element wires 5 is at least three times greater than the outer diameter C of the conductor portion 3 but no more than thirty times greater than the outer diameter C of the conductor portion 3. The above stranding pitch A is far less than the stranding pitch of the element wires of a conventional electrical wire. As such, the element wires 5 of the conductor portion 3 are more tightly twisted together in comparison with the element wires of the conductor portion of the conventional electrical wire. As a result, the surplus length of the element wire(s) 5 constituting the conductor portion 3 inside the electrical wire 1 is much greater than the surplus length of the element wire(s) of the conductor portion of the conventional electrical wire.

For the reason as set forth above, even if the electrical wire 1 is repeatedly bent, distortion of the element wire 5 due to the above repetitive bend can be reliably decreased. Therefore, the element wires 5 formed of aluminum or aluminum alloy material can be effectively prevented from break or fracture even if they are used for a wiring harness to be disposed inside a vehicle.

Moreover, in a case where the stranding pitch A of the element wires 5 is at least three times greater than the outer diameter C of the conductor portion 3 but no more than twenty times greater than the outer diameter C of the conductor portion 3, distortion of the element wire 5 due to the repetitive bend can be reliably decreased. Therefore, the element wires 5 formed of aluminum or aluminum alloy material can be effectively prevented from break or fracture even if they are used for a wiring harness to be disposed inside a vehicle.

In addition, in a case where the stranding pitch A of the element wires 5 is at least five times greater than the outer diameter C of the conductor portion 3, but no more than fifteen times greater than the outer diameter C of the conductor portion 3, distortion of the element wire 5 due to the repetitive bend can be reliably decreased. Therefore, the element wires 5 formed of aluminum or aluminum alloy material can be effectively prevented from break or fracture even if they are used for a wiring harness to be disposed inside a vehicle.

The inventors prepared electrical wires 1 of varied stranding pitches A. Subsequently, the electrical wires 1 were subjected to repetitive bending to determine the number of bending until at least one element wire 5 breaks or fractures. The results are shown in FIGS. 6 and 7.

Figure 6:
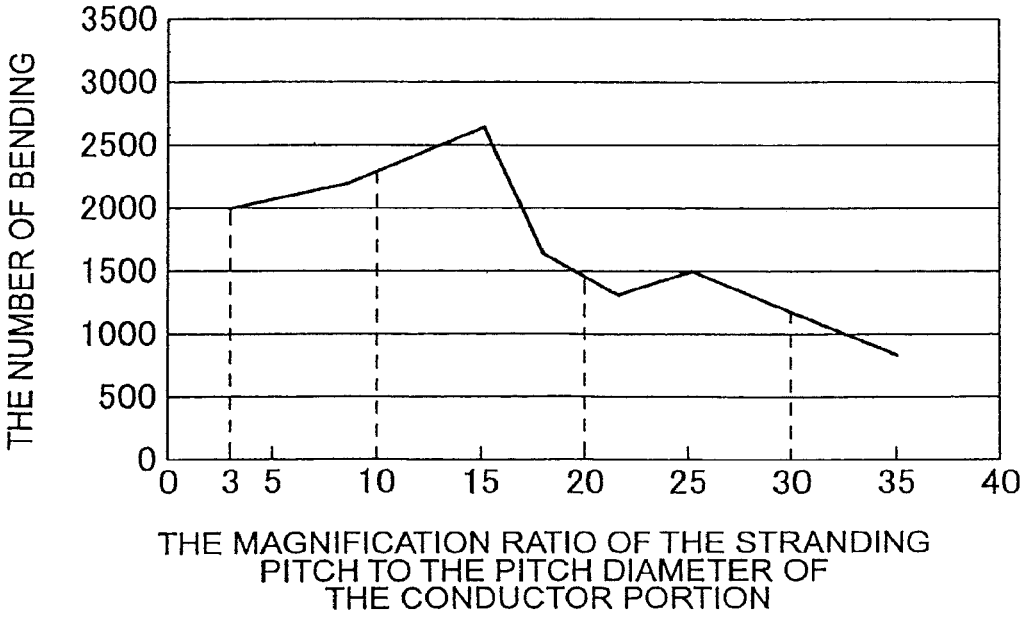
FIG. 6 shows the relationship between the magnification ratio of the stranding pitch to the pitch diameter of the conductor portion (as illustrated by a horizontal axis), and the number of bending until at least one element wire breaks or fractures (as illustrated by a vertical axis) for the first embodiment of the electrical wire.
Figure 7:
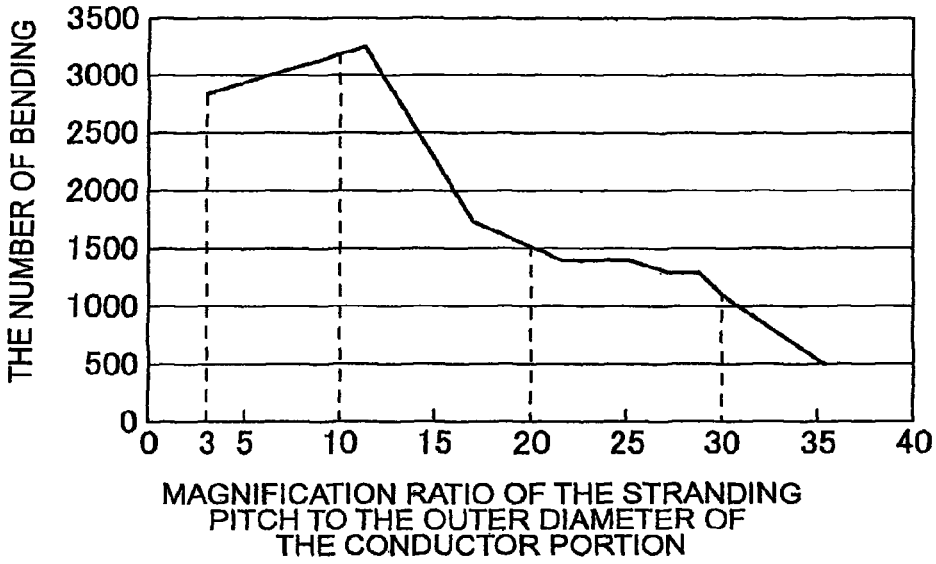
FIG. 7 shows the relationship between the magnification ratio of the stranding pitch to the outer diameter of the conductor portion (as illustrated by a horizontal axis), and the number of bending until at least one element wire breaks or fractures (as illustrated by a vertical axis) for the second embodiment of the electrical wire.

With reference to FIGS. 6 and 7, a horizontal axis represents the magnification ratio of the stranding pitch A of the element wires 5 to the pitch diameter B or the outer diameter C of the conductor portion 3, and a vertical axis represents the number of bending until at least one element wire 5 breaks or fractures. For more detail, FIG. 6 is shown for the first embodiment of the electrical wire 1 (i.e., the electrical wire 1 having the conductor portion 3 having the element wires 5 which are not subjected to compression, and have circular cross-section respectively). FIG. 7 is shown for the second embodiment of the electrical wire 1 (i.e., the electrical wire 1 having the conductor portion 3 having the element wires 5 which are subjected to compression, and thus have approximately hexagonal cross-section respectively).

Figure 8:
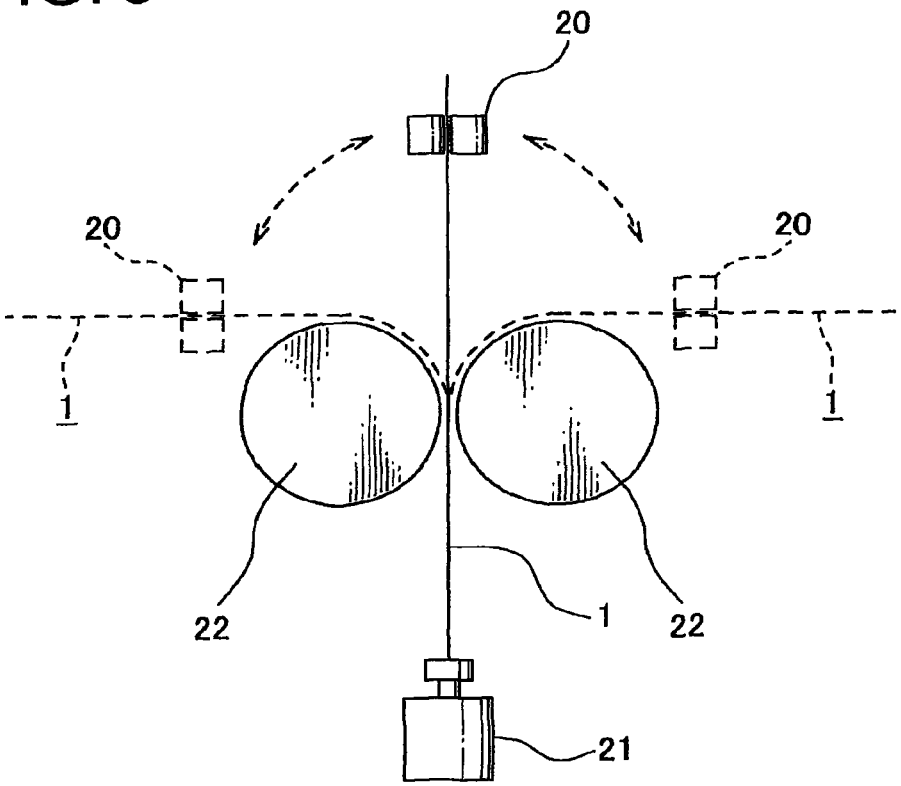
FIG. 8 illustrates how to repetitively bend the electrical wire by use of a device such as jigs.

When the electrical wire 1 is subjected to repetitive bending, one end (i.e., a superior edge) of the electrical wire 1 is fixed to a jig 20, and the other end (i.e., a lower end) of the electrical wire 1 is coupled to a weight. For more detail, see FIG. 8. The electrical wire 1 is passed between two cylindrical bending jigs 22. The jig 20 is moved toward the one of the bending jigs 22, the one end of the electrical wire 1 is then bent along the outer periphery of the one of the bending jigs 22, the jig 20 is then moved toward the other bending jig 22, and the one end of the electrical wire 1 is then bent along the outer periphery of the other bending jig 22. As such, the electrical wire 1 is alternately, repeated, and inversely bent with respect to each other. If the number of bending for the electrical wire 1 is 1000 or above before at least one element wire 5 breaking or fracturing, the corresponding electrical wire 1 is determined to be suitable for use in a wiring harness to be disposed in a vehicle.

In accordance with FIGS. 6 and 7, the electrical wire 1 having the conductor portion 3 with a plurality of the element wires 5 the stranding pitch A of which is at least three times greater than the pitch diameter B or the outer diameter C of the conductor portion 3 but no more than thirty times greater than the pitch diameter B or the outer diameter C of the conductor portion 3 survived without any break or fracture of element wires 5 after repetitive bending of 1000 or above (number) was performed on the electrical wire 1. The results demonstrates that the element wires 5 formed of aluminum or aluminum alloy material so as to constitute a part of the electrical wire 1 do not have a tendency to break or fracture even if the electrical wire 1 is employed in a wiring harness for a vehicle. In other words, the fatigue strength of the electrical wire 1 is remarkably enhanced. In addition, in accordance with FIGS. 6 and 7, the electrical wire 1 having the conductor portion 3 with a plurality of the element wires 5 the stranding pitch A of which is at least three times greater than the pitch diameter B or the outer diameter C of the conductor portion 3 but no more than twenty times greater that the pitch diameter B or the outer diameter C of the conductor portion 3 survived without any break or fracture of the element wires 5 after repetitive bending of 1000 or above (number) was performed on the electrical wire 1. The result demonstrates that the element wires 5 formed of aluminum or aluminum alloy material so as to constitute a part of the electrical wire 1 do not have a tendency to break or fracture even of the electrical wire 1 is employed in a wiring harness for a vehicle. In other words, the fatigue strength of the electrical wire 1 is remarkably enhanced.

In accordance with FIG. 6, in the case of the electrical wire 1 having the conductor portion 3 with a plurality of the element wires 5 the stranding pitch A of which is at least ten times greater than the pitch diameter B of the conductor portion 3 but no more than twenty times greater than the pitch diameter B of the conductor portion 3, the element wires 5 formed of aluminum or aluminum alloy material so as to constitute a part of the electrical wire 1 do not have a tendency to break or fracture even if the electrical wire 1 is employed in a wiring harness for a vehicle. In other words, the fatigue strength of the electrical wire 1 is remarkably enhanced. In addition, in accordance with FIG. 7, in the case of the electrical wire 1 having the conductor portion 3 with a plurality of the element wires 5 the stranding pitch A of which is at least five times greater than the outer diameter C of the conductor portion 3 but no more than fifteen times greater that the outer diameter C of the conductor portion 3, the element wires 5 formed of aluminum or aluminum alloy material so as to constitute a part of the electrical wire 1 do not have a tendency to be ruptured even of the electrical wire 1 is employed in a wiring harness for a vehicle. In other words, the fatigue strength of the electrical wire 1 is remarkably enhanced.

Other embodiments and uses of the invention will be apparent to those skilled in the art from consideration from the specification and practice of the invention disclosed herein. It is understood that the invention is not limited to the embodiments and/or examples herein described, but embraces such modified forms thereof as come within the scope of the following claims.

The invention claimed is:

1. An electrical wire, comprising: a conductor portion comprising a plurality of element wires being twisted together, each element wire consisting of pure aluminum material and inevitable or unavoidable impurities other than pure aluminum and being formed as a compressed conductor; and an insulating covering portion disposed over the conductor portion, wherein a stranding pitch of the element wires is at least three times greater than an outer diameter of the conductor portion but no more than thirty times greater than the outer diameter of the conductor portion.

2. The electrical wire according to claim 1, wherein the stranding pitch of the element wires is at least three times greater than the outer diameter the conductor portion but no more than twenty times greater than the outer diameter of the conductor portion.

3. The electrical wire according to claim 1, wherein the stranding pitch of the element wires is at least five times greater than the outer diameter the conductor portion but no more than fifteen times greater than the outer diameter of the conductor portion.

4. The electrical wire according to claim 1, wherein each element wire has an approximately hexagonal cross-section.

5. The electrical wire according to claim 2, wherein each element wire has an approximately hexagonal cross-section.

6. The electrical wire according to claim 3, wherein each element wire has an approximately hexagonal cross-section.

7. The electrical wire according to claim 1, wherein a first element wire arranged in a center side of the electrical wire has a first diameter and wherein a second element wires arranged on an outer periphery of the first element wire each has a second diameter, as viewed from cross-section.

* * * * *